United States Patent [19]

Attenburrow

[11] 4,156,946

[45] Jun. 5, 1979

[54] TRANSFER DEVICE

[75] Inventor: David J. Attenburrow, Bridlington, England

[73] Assignee: Reed International Limited, Great Britain

[21] Appl. No.: 912,883

[22] Filed: Jun. 5, 1978

[51] Int. Cl.[2] ..... A61G 7/10; G05G 1/04

[52] U.S. Cl. ..... 5/81 R; 5/86; 74/548

[58] Field of Search ..... 5/81 R, 81 C; 74/545, 74/548

[56] References Cited

U.S. PATENT DOCUMENTS

| | | | |
|---|---|---|---|
| 3,654,644 | 4/1972 | Stevens | 5/81 C |
| 3,760,435 | 9/1973 | Jardins | 5/81 C |
| 3,781,929 | 1/1974 | Stevens | 5/81 C |
| 3,854,152 | 12/1974 | Chez | 5/81 C |
| 3,871,036 | 3/1975 | Attenburrow | 5/81 R |

*Primary Examiner*—Casmir A. Nunberg
*Attorney, Agent, or Firm*—Schiller & Pandiscio

[57] ABSTRACT

A patient transfer device comprises a belt connected at its ends to first and second reels and in its extension from the first reel to the second reel defines in turn an upper patient supporting portion and a lower ground engaging portion. Each of said reels is selectively rotatable so that in a first mode of operation of the transfer device with said first reel driven the belt is taken-up by the first reel and let out by the second reel and in a second mode of operation the belt is taken up by the second reel and let out by the first reel. An auxiliary belt take-up and let-out device is connected to the belt at a position between its upper patient supporting portion and its lower ground engaging portion and is selectively lockable to enable the first and second modes of operation to be performed. With said first reel locked said auxiliary device can be driven so that in a third mode of operation the belt is taken up by the auxiliary device and let out by the second reel and in a fourth mode of operation rotation of said second reel with said auxiliary device unlocked the belt is taken up by the second reel and let out by the auxiliary device. The first and second reels and the auxiliary device are provided with driving shafts to which a manually operable driving handle can be individually fitted. The locking and unlocking of the first reel and the auxiliary device is effected automatically by the fitting of the handle to respective driving shafts for effecting a take-up operation of the second reel in the second and fourth modes of operation.

7 Claims, 9 Drawing Figures

TRANSFER DEVICE

Figure 1:
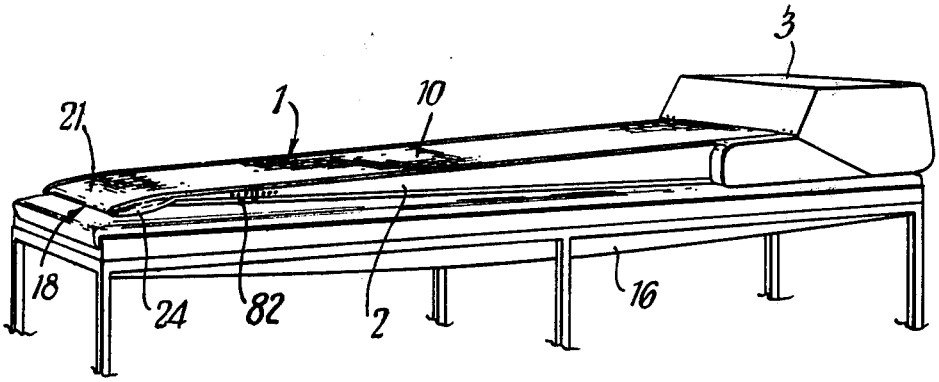

This invention is concerned with transfer devices for transferring a hospital patient between a bed, chair, operating table, x-ray table or the like and a trolley or the like and relates to modifications of the transfer device described and claimed in my U.S. Pat. No. 3,871,036.

In my U.S. Pat. No. 3,871,036 a patient transfer device is described which comprises a belt connected at its ends to first and second reels and in its extension from the first reel to the second reel passing over supporting and guiding means to define in turn an upper patient supporting portion and a lower ground engaging portion. Driving means are provided for selectively rotating each of said reels so that in a first mode of operation of the transfer device with said first reel driven the belt is taken-up by the first reel and let out by the second reel, in a second mode of operation the belt is taken up by the second reel and let out by the first reel. The course of the belt over the supporting and guiding means is such that in each of the first and second modes the belt is moving in the same direction relative to the ground over its upper patient supporting portion and its lower ground engaging portion. An auxiliary belt take-up and let-out device is connected to the belt at a position between its upper patient supporting portion and its lower ground engaging portion and locking means are provided for selectively locking the auxiliary device to enable the first and second modes of operation to be performed. Means are provided for selectively actuating said auxiliary device and locking means are provided for locking said first reel so that in a third mode of operation with said auxiliary device actuated the belt is taken up by the auxiliary device and let out by the second reel. In a fourth mode of operation in which said first reel is locked said second reel is rotated by said driving means so that the belt is taken up by the second reel and let out by the auxiliary device.

By the term "ground" as used herein is meant any surface on which the transfer device operates, for example the top of a trolley, a bed mattress or the surface of an operating or x-ray table.

In my aforesaid U.S. Pat. No. 3,871,036 the driving means described is electrically operated. The main object of the present invention is to provide a transfer device as set out above but having manually operated driving means rather than electrically operated driving means.

According to one aspect of the present invention, the first and second reels and said auxiliary belt take-up and let-out device are provided with driving shafts to which a manually operable driving handle can be individually fitted to effect driving engagement between the handle and the shafts, and means are provided for locking said first reel and said auxiliary device, which means are selectively unlocked by the fitting of said handle to said shafts.

Advantageously said locking means may comprise co-operating pawls and ratchets and the fitting of said handles to said shafts arranged to cause selective disengagement of said pawls from their associated ratchets. This may be achieved by the outer surface of the handle as it is fitted displacing by a camming action a plate which in turn rotates a shaft carrying segments for engaging the pawls to release them from the ratchets.

In my U.S. Pat. No. 3,871,036, the transfer device is mounted on a trolley in order to transport it from one location to another, and tracks from the upper surface of said trolley on to a bed, operating, x-ray table or the like. A second object of this invention is to improve the tracking of the device along the surface of the trolley by preventing belt slip on the surface of the trolley.

In order to achieve this object, according to a second aspect of the invention the belt over its ground engaging portion is secured to the trolley at a point which is at or adjacent the front end of the transfer device.

Figure 2:
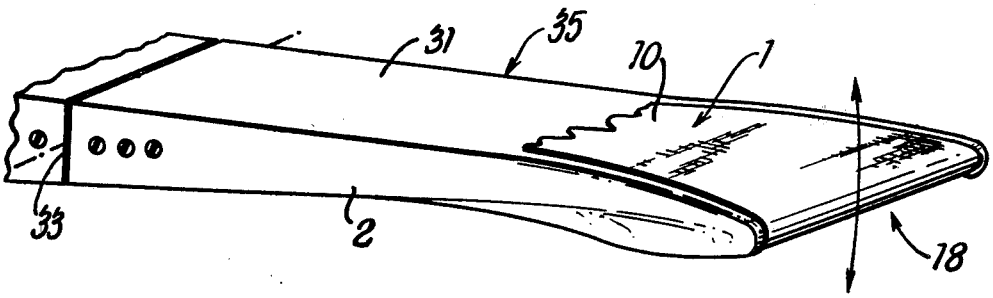
Figure 3:
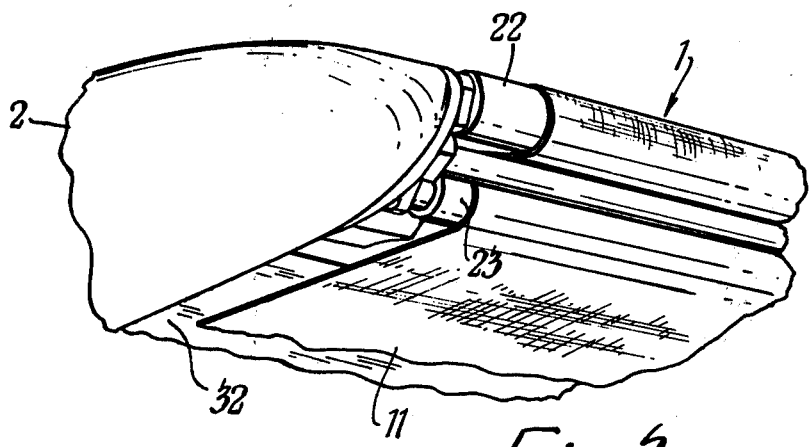
Figure 4:
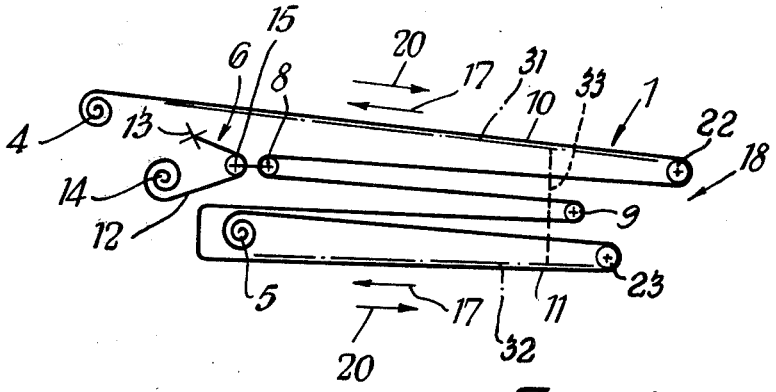
Figure 5:
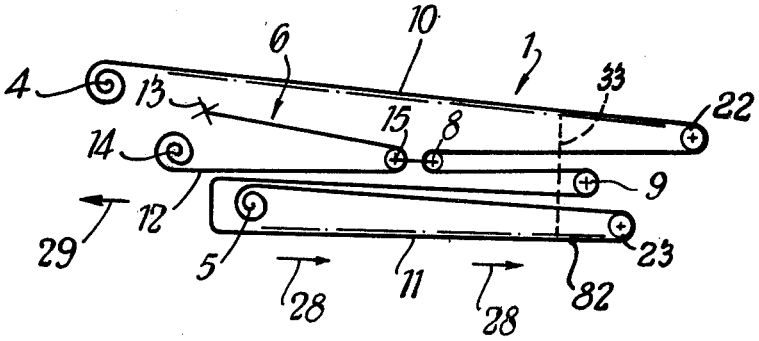
Figure 6:
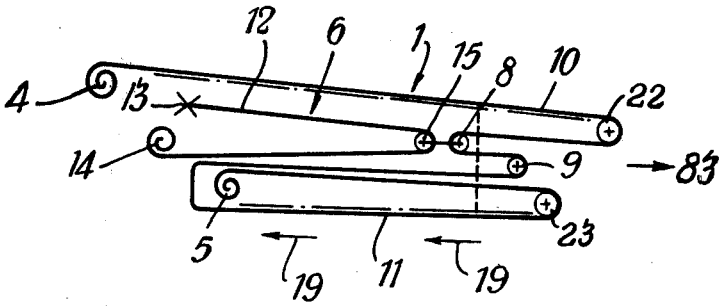
Figure 7:
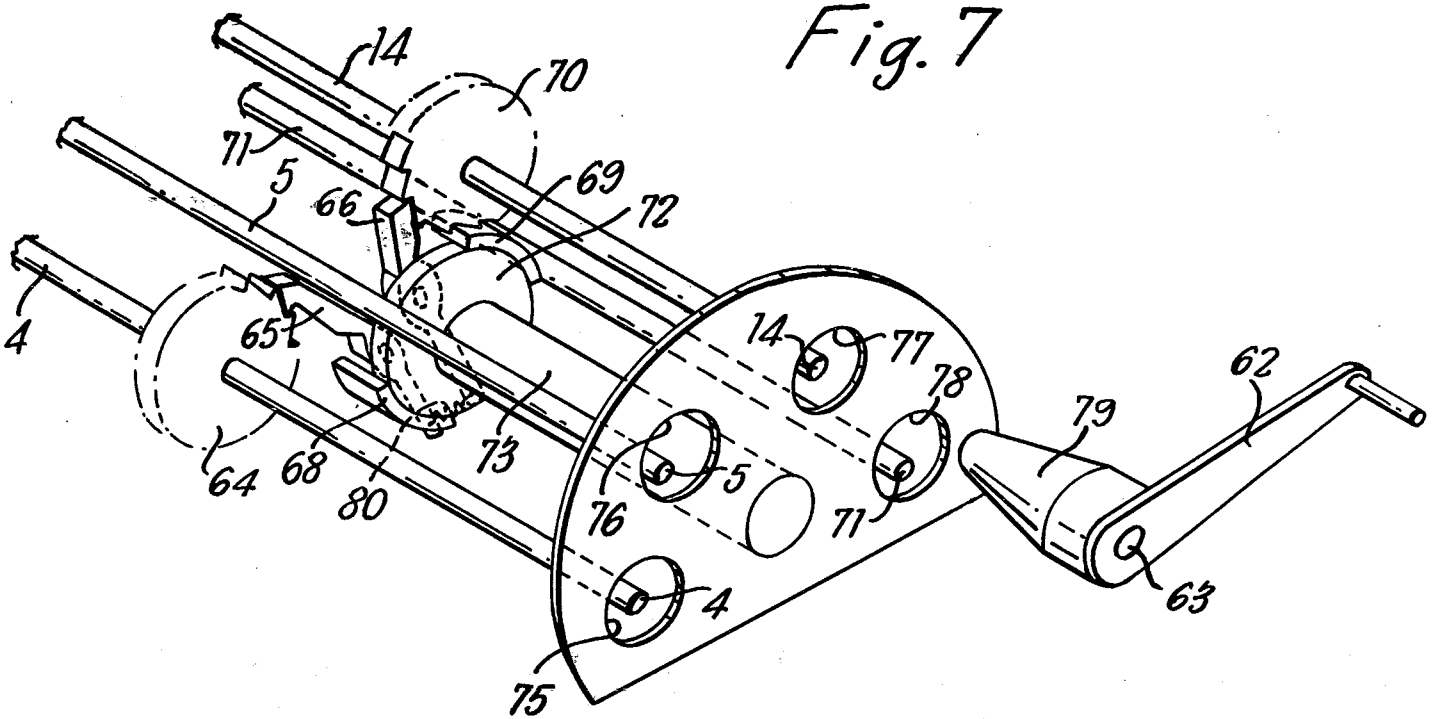
Figure 8:
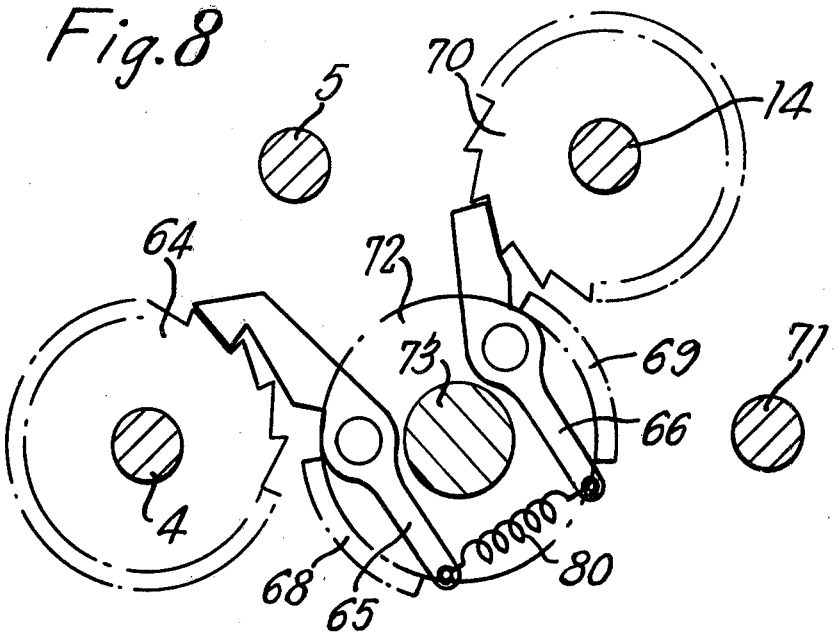
Figure 9:
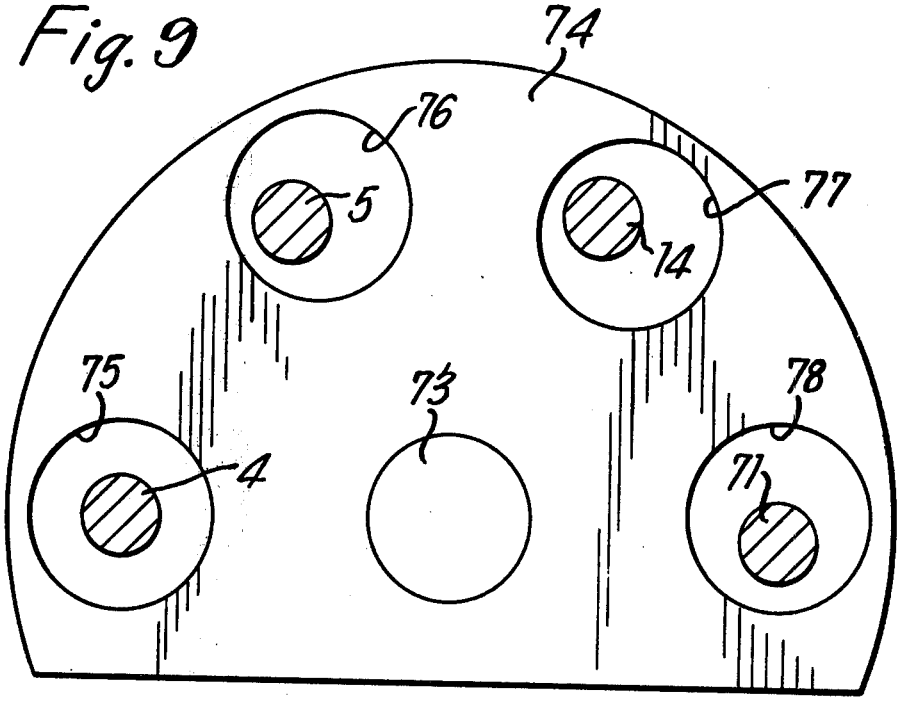

One patient transfer device in accordance with the invention will now be described by way of example with reference to the accompanying drawings, in which:

FIG. 1 is a perspective view of the transfer device shown mounted on a trolley, FIG. 2 is a perspective view of the forward end of the device from above, FIG. 3 is a perspective view of the forward end of the device from below, FIGS. 4 to 6 are diagrammatic views showing the course of the belt and illustrating the different modes of operation of the transfer device, FIG. 7 illustrates diagrammatically the driving arrangement for the transfer device, FIG. 8 illustrates diagrammatically and to a larger scale than FIG. 7 a part of the driving arrangement, and FIG. 9 illustrates diagrammatically an end view of the driving arrangement.

The transfer device has a belt 1 located between side frame structures 2 and at its rear end a housing 3. The housing 3 encloses belt reels 4 and 5 and auxiliary take-up and let-out device 6 incorporating reel 14 (FIGS. 4 to 6). It also encloses manually operated driving means for reels 4 and 5 and 14 as will be described.

Referring to FIGS. 4 to 6 the belt extends from the reels 4 and 5 and passes over guide rollers only some of which, referenced 8, 9, 22 and 23, are shown. Other guide rollers are positioned to provide the appropriate support for the run of the belt so that it follows the course shown. Thus the belt defines an upper patient supporting portion 10 and a lower ground engaging portion 11. Behind the belt 1 over the portions 10 and 11 are positioned supporting plates shown diagrammatically at 31 and 32 in FIG. 4, a part of the plate 31 being shown in FIG. 2 and a part of the plate 32 being shown in FIG. 3. These plates are attached at their edges to the side frame structure 2 and provide substantially flat surfaces over which the belt skids or slides. The front end of the side frames 2 together with the associated parts of the support plates 31 and 32 form a nose portion 35 (see FIG. 2) which is hinged at 33 so that it can move up and down relative to the remainder of the transfer device.

The auxiliary take-up and release device 6 comprises a belt 12 connected at one end to an anchorage 13 and at its other end to the reel 14. Between the anchorage 13 and reel 14 the belt 12 passes over a floating roller 15 which is connected to the idler roll 8.

FIGS. 7, 8 and 9 show diagrammatically the manual drive arrangement for the reels 4, 5 and 14. The manual drive is achieved by an operating handle 62 which is engageable over the ends of reel driving shafts so that it becomes keyed to them. For ready identification the reel driving shafts have been given the same reference numerals as their associated reels, namely 4, 5 and 14. A further driving shaft 71 is provided and this is connected through a 1:1 gearing to the reel shaft 5 for driving the reel 5. The need for this further drive shaft will become apparent from the later description. The handle 62 is arranged to rotate the shafts 4, 5, 14 and 71 in a clockwise direction as seen in FIG. 8, and incorporates a ratchet 63 to prevent rotation of the shafts in the opposite direction.

As will become apparent from the operation of the drive described hereafter, it is necessary to selectively lock and unlock the shafts 4 and 14 in order to perform the different modes of operation of the transfer device. For this purpose the shafts 4 and 14 carry ratchet wheels 64 and 70 which are engaged by pawls 65 and 66 respectively. The pawls 65 and 66 are pivotally mounted on the frame structure of the transfer device and are biased into engagement with the ratchet wheels 64 and 70 by a common spring 80 to lock the shafts 4 and 14 against rotation in an anti-clockwise direction as seen in FIGS. 7 and 8. Segments 68 and 69 are mounted on the periphery of a carrier 72 in the form of a collar on a shaft 73 for disengaging the pawls 65 and 66 from the ratchet wheels 64 and 70. Thus as seen in FIG. 8 a relatively small clockwise rotation of the shaft 73 and hence carrier 72 will cause segment 68 to disengage pawl 65 from ratchet wheel 64 to unlock shaft 4 and a similar anti-clockwise rotation will cause segment 69 to disengage pawl 66 from ratchet wheel 70 to unlock shaft 14.

The rotation of shaft 73 is achieved by a cam plate 74 rigidly mounted on the end of the shaft 73. The cam plate 74 has a series of four circular holes 75, 76, 77 and 78 arranged in an arc about the axis of the shaft 73. In order to connect the handle 62 to the selected one of the shafts the connecting end 79 of the handle has to pass through a respective one of the holes 75 to 78. The axes of the shafts 5, 14 and 71 as can best be seen from FIG. 9 are eccentric to the holes 75 to 78 so that as the connecting end 79 of the handle 62 is inserted into one of these holes it engages the side of the hole and by a camming action displaces the plate 75 and so rotates the shaft 73. The direction of the eccentricity is selected to achieve the desired clockwise or anticlockwise rotation of the shaft 73. To facilitate the displacement of the plate 74 and passage of the handle 62 through the holes, the outer surface of the connecting end 79 is tapered. The shaft 4 is concentrically mounted with respect to its associated hole 75, since when the shaft 4 is rotated directly by the handle the pawl 65 permits the consequent clockwise rotation of the ratchet 64 and there is no requirement to unlock the pawl 66 from the ratchet 70.

The further constructional features of the transfer device will become apparent from the operating modes now to be described as used to transfer a patient from a bed on to a trolley and then transfer him from the trolley on to an operating table.

The initial position of the belt is as shown in FIG. 4 with the transfer device supported on trolley 16 as shown in FIG. 1. With the handle 62 not fitted to any of the drive shafts 4, 5, 14 and 71 the shaft 73 and cam plate 74 are biased to a neutral position in which both ratchet wheels 64 and 70 are engaged by pawls 65 and 66 to lock both shafts 4 and 14. The trolley is moved so that it is end on to the head or fott of a divan type bed or diagonal to the bed. In the case of a bed with ends which can not be removed the trolley must be moved to a position diagonal to the bed. If necessary the trolley is adjusted in height so that the centre line of roller 22 is level with the bed mattress surface.

To move the trolley on to a bed under a patient the handle 62 is fitted to shaft 4. As previously stated the shaft 14 remains locked by pawl 66 engaging ratchet wheel 70. Rotation of the handle 62 in the clockwise direction then causes reel 4 to be driven to take up the belt 1 so that over its portions 10 and 11 the belt moves in the direction of the arrows 17. Thus the forward end 18 of the transfer device trackes under the patient and since the belt portions 10 and 11 are moving at the same speed the patient will be loaded onto the transfer device without relative movement between the patient and the bed.

During this movement the nose portion of the transfer device is allowed to move freely up or down independently of the remainder of the transfer device by virtue of the hinge 33, thus ensuring that rollers 22 and 23 at the forward extremity will follow the contours in the surface of the mattress caused by the unevenly distributed weight of the patient on the mattress.

When the patient has been loaded onto the transfer device the handle 62 is fitted to shaft 5 and this displaces cam plate 74 to rotate shaft 73 in the direction to cause pawl 66 to disengage from ratchet wheel 70 and hence unlock shaft 14 so that it is free to rotate in a clockwise direction as seen in FIGS. 7 and 8. At this time the shaft 4 is locked by pawl 65 and ratchet wheel 64. Rotation of handle 62 then rotates reel 5 to cause the belt to be taken up by the reel 5. This causes the transfer device to track off the bed back onto the trolley in the direction of arrow 29 (FIG. 5) by movement of the ground engaging portion 11 of the belt in the direction of arrows 28 (FIG. 5). The patient supported by portion 10 of the belt remains stationary relative to the transfer device the necessary reserve of the belt being provided by the belt 12 being pulled from the reel 14 permitted the roller 15 and thus the roller 8 to move to the right. The limiting right-hand position of the rollers 15 and 8 is as shown in FIG. 6.

After moving the trolley 16 to the operating theatre it is aligned end on with the operating table. The handle is then fitted to shaft 14 to displace cam plate 74 and so rotate shaft 73 in the direction to cause pawl 66 to disengage from ratchet wheel 70, the reel 4 being locked at this time. Rotation of the handle 62 then rotates reel 14 clockwise to cause the rollers 15 and 8 to move to the left from the position shown in FIG. 6. This will cause the transfer device to track forward in the direction of arrow 83 by movement of the belt 1 in the direction of arrows 19 (FIG. 6), the patient supported on portion 10 of the belt remaining stationary relative to the transfer device.

To remove the transfer device from beneath the patient and back on to the trolley the handle 62 is fitted to shaft 71 to displace cam plate 74 and cause rotation of the shaft 73 to release pawl 65 from ratchet wheel 64 to unlock shaft 4. Rotation of handle 62 will then cause rotation of shaft 71 and hence shaft 5 through the 1:1 gearing to cause the reel 5 to be rotated and thus the belt portions 10 and 11 to move in the direction of arrows 20 (FIG. 4). It will be appreciated that this mode of operation requires unlocking of shaft 4 whereas that described with reference to FIG. 5, which also entailed clockwise rotation of shaft 5, required unlocking of shaft 14; hence the need for the additional shaft 71 and its associated hole 78 in the cam plate 74.

All movements of the transfer device rely upon traction between the undersurface of the belt and the ground and, whilst this traction is satisfactory with the motorised version described in patent specification No. 1,415,683 owing to the weight of the gear unit, it is possible for this surface of the belt to slip on the trolley top when the above described manually operated driving arrangement is employed. To avoid this slipping the belt is fixed at one point of the belt to the trolley at a point marked 82 on FIGS. 1 and 5. This feature ensures that any movement of the frame 2 is directly proportional to the movement of belts 1 and 12 during rotation of reels 4, 5 and 14 thus avoiding any slip between the under surface of belt 1 and the trolley top.

In addition stops are fixed to the frame in a suitable position, one to arrest roller 15 at its limiting position shown in FIG. 4 and another to arrest the movement of roller 8 in its limiting position shown in FIG. 6. The extent of movement of reel 5 is achieved by completely unwinding the belt 1 to its limit from reel 4. The same would apply when operating reel 4 which would be limited by the unwinding of the belt 1 to its limit from reel 5.

I claim:

1. A patient transfer device comprising a belt connected at its ends to first and second reels and in its extension from the first reel to the second reel passing over supporting and guiding means to define in turn an upper patient supporting portion and a lower ground engaging portion, driving means for selectively rotating each of said reels so that in a first mode of operation of the transfer device with said first reel driven the belt is taken-up by the first reel and let out by the second reel, in a second mode of operation the belt is taken up by the second reel and let out by the first reel, the course of the belt over the supporting and guiding means being such that in each of the first and second modes the belt is moving in the same direction relative to the ground over its upper patient supporting portion and its lower ground engaging portion, an auxiliary belt take-up and let-out device connected to the belt at a position between its upper patient supporting portion and its lower ground engaging portion, means for selectively locking the auxiliary device to enable the first and second modes of operation to be performed, means for selectively actuating said auxilary device and means for locking said first reel so that in a third mode of operation with said auxiliary device actuated the belt is taken up by the auxiliary device and let out by the second reel and in a fourth mode of operation in which said second reel is rotated by said driving means the belt is taken up by the second reel and let out by the auxiliary device, characterised in that the first and second reels and said auxiliary belt take-up and let-out device are provided with driving shafts to which a manually operable driving handle can be individually fitted to effect driving engagement between the handle and the shafts, and means are provided for locking said first reel and said auxiliary device against a letting-out operation, which means are selectively unlocked by the fitting of said handle to respective driving shafts for effecting a take-up operation of said second reel in said second and fourth modes of operation.

2. A patient transfer device according to claim 1, wherein a rotatable unlocking device is provided and wherein the fitting of said handle to said driving shafts for said second reel causes a camming action between said handle and said unlocking device to effect rotation of said unlocking device.

3. A patient transfer device according to claim 2, wherein said unlocking device comprises a plate having holes therein through which access to said driving shafts is achieved by said handle, the holes for said driving shafts for said second reel being eccentric of the axes of said last mentioned shafts so that said camming action is between the outer surface of said handle and the edges of said eccentric holes.

4. A patient transfer device according to claim 3, wherein the connecting end of said driving handle is tapered to effect said camming action.

5. A patient transfer device according to claim 1 wherein said locking means comprises cooperating pawls and ratchets and fitting of said handle to said driving shafts for said second reel causes selective disengagement of said pawls from their associated ratchets.

6. A patient transfer device according to claim 5 wherein a rotatable unlocking device is provided the fitting of said handle to said driving shafts for said second reel causing a camming action between said handle and said unlocking device to effect rotation of said unlocking device and wherein said unlocking device is arranged to rotate a shaft carrying projections for engaging the pawls to release them from the ratchets.

7. In combination a patient transfer device and a trolley upon which the transfer device is supported, said patient transfer device comprising a belt connected at its ends to first and second reels and in its extension from the first reel to the second reel passing over supporting and guiding means to define in turn an upper patient supporting portion and a lower ground engaging portion, driving means for selectively rotating each of said reels so that in a first mode of operation of the transfer device with said first reel driven the belt is taken-up by the first reel and let out by the second reel, in a second mode of operation the belt is taken up by the second reel and let out by the first reel, the course of the belt over the supporting and guiding means being such that in each of the first and second modes the belt is moving in the same direction relative to the ground over its upper patient supporting portion and its lower ground engaging portion, an auxiliary belt take-up and let-out device connected to the belt at a position between its upper patient supporting portion and its lower ground engaging portion, means for selectively locking the auxiliary device to enable the first and second modes of operation to be performed, means for selectively actuating said auxiliary device and means for locking said first reel so that in a third mode of operation with said auxiliary device actuated the belt is taken up by the auxiliary device and let out by the second reel and in a fourth mode of operation in which said second reel is rotated by said driving means the belt is taken up by the second reel and let out by the auxiliary device, wherein said belt over its ground engaging portion is secured to the trolley at a point which is at or adjacent the front end of the transfer device when at its rest position on the trolley.

* * * * *

UNITED STATES PATENT AND TRADEMARK OFFICE

CERTIFICATE OF CORRECTION

PATENT NO. : 4156946

DATED : June 5, 1979

INVENTOR(S) : David James Attenburrow

It is certified that error appears in the above-identified patent and that said Letters Patent are hereby corrected as shown below:

Title page, column 1, after item line [22]

Insert the following:

[30] Foreign Application Priority Date

June 10, 1977 [GB] United Kingdom.....24310/77

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*